United States Patent [19]

Ruhl

[11] 4,218,907

[45] Aug. 26, 1980

[54] ROLLING MILL BEARING ASSEMBLY

[75] Inventor: Robert C. Ruhl, Cleveland Heights, Ohio

[73] Assignee: Kennecott Copper Corporation, New York, N.Y.

[21] Appl. No.: 7,909

[22] Filed: Jan. 31, 1979

[51] Int. Cl.[3] ..... B21B 13/14

[52] U.S. Cl. ..... 72/241

[58] Field of Search ..... 72/241, 237; 100/155 R

[56] References Cited

U.S. PATENT DOCUMENTS

| | | | |
|---|---|---|---|
| Re. 21,988 | 12/1941 | Hudson et al. | 72/241 X |
| 1,558,633 | 10/1925 | Rockwell | 72/241 |
| 1,901,284 | 2/1933 | Carlson | 226/194 |
| 2,135,465 | 11/1938 | Eldred | 164/282 |
| 3,528,488 | 4/1970 | Bode, Jr. | 164/282 |
| 3,550,676 | 12/1970 | Gallucci | 164/282 |
| 3,561,241 | 2/1971 | Blain | 72/241 X |
| 3,965,974 | 6/1976 | Sernetz et al. | 165/89 |
| 4,033,497 | 7/1977 | Przygocki | 226/194 |
| 4,037,647 | 7/1977 | Streubel | 164/282 |
| 4,046,188 | 9/1977 | Kagerhuber et al. | 164/282 |

*Primary Examiner*—Milton S. Mehr

*Attorney, Agent, or Firm*—John L. Sniado; Anthony M. Lorusso

[57] ABSTRACT

Bearing assemblies for supporting cylindrical, metal-rolling rolls. The bearings are housed in chock blocks and comprise both radial and thrust bearings. The radial bearings are hemi-cylindrical in shape and extend around approximately one half of the circumference of each roll and make contact with the surface of each roll thereby minimizing lateral roll deflections. A thrust bearing engages a fraction of the surface of at least one end face of each roll. Both the radial and thrust bearings are preferably made of high strength, mechanical graphite or carbon.

2 Claims, 3 Drawing Figures

ROLLING MILL BEARING ASSEMBLY

BACKGROUND OF THE INVENTION

This invention relates to a metal-rolling roll assembly and more particularly to a bearing assembly for supporting a cylindrical metal-rolling roll during a rolling operation.

Conventional rolling mills fall into three categories: two-high, four-high and miscellaneous mills. The two-high mills, include two rolling (or work) rolls supported by roll neck bearings. Two-high mills generally use rolls of relatively large diameters in order to achieve high roll stiffness. Large diameter rolls also permit larger roll-neck bearings thereby increasing the maximum rolling force available. Roll stiffness is an important factor in the quality of the finished product; generally, the stiffer the roll (its resistance to bending deflections), the flatter the finished strip. For several reasons, however, small roll diameters are desirable for rolling rolls. With small roll diameters, the size and cost of the overall mill assembly is reduced. Also, a roll of small size requires a lower rolling force for a given work piece thickness reduction, and also allows thinner products to be rolled. Additionally, small roll size leads to a reduction in roll-face contact pressures, total rolling friction, and the required driving torque for turning the roll.

The conflict between the desirability of large roll diameter for stiffness and high rolling force and the aforementioned advantages of smaller roll size has been resolved traditionally by replacing two-high mills with four-high mills or miscellaneous mills (three-high, five-high, six-high, cluster mills, planetary mills, etc.) The four-high mills utilize small diameter rolling (work) rolls supported throughout their lengths by larger diameter backup rolls. The backup rolls thus provide the desired stiffness for resisting radial deflections of the work rolls. The large diameter backup rolls also permit the use of large roll neck bearings for high maximum separating (i.e. rolling) force. Although four-high and miscellaneous mills do meet the technical objectives for accomplishing large thickness reductions in a single mill stand and for producing good quality finished products, there are disadvantages to this approach. The major disadvantages of the four-high and miscellaneous mills over two-high mills are the greater mechanical complexity, larger size, and higher cost, both initial and operating, as compared with the simpler two-high mills. Additionally, the surface of the product from four-high and miscellaneous mills is of poorer quality under some operating conditions than that produced in two-high mills.

The rolls in two-high, four-high and miscellaneous mills are supported at their ends by roll neck bearings of three general types: tapered roller, oil film, and sleeve. These bearings usually require a continuous, flowing supply of lubricating oil. Often this bearing lubricant is incompatible with the metal rolling lubricant and coolant, necessitating two well-isolated recirculating systems. These require elaborate oil seals and complex fitting and assembly procedures which add both to operating and initial costs. The fact that roll necks often require accurate tapers, steps, and grooves for the seals and bearings also adds to costs. Roll neck bearings are disadvantageous, too, in that only the roll ends are supported during a rolling operation. Thus, lateral deflections of the roll while rolling metal are not significantly prevented when rolls with these bearings are utilized.

An object of the present invention, therefore, is to provide a new design for a rolling mill assembly which permits simple and low cost rolling mills capable of accomplishing large thickness reductions while making high quality products.

Another object of this invention is to provide a new bearing design which makes possible the use of small diameter rolling rolls (without backup rolls) in the production of high-quality finished products without the need for separate bearing and metal rolling lubricants and the attendant seals to keep the two lubricants apart.

A still further object of the invention is to provide a bearing design for accomodating small diameter rolls which minimizes the amount of lateral roll deflections produced when the roll is used in a rolling operation.

Yet a further object of the invention is to provide a bearing design which makes roll maintenance and roll changing easy.

Other objects, features, and advantages of the present invention will become apparent from what follows.

SUMMARY OF THE INVENTION

Rolling mill bearing assemblies for supporting cylindrical rolling rolls during a rolling operation according to the present invention include chock blocks which hold the bearing elements and the rolls. A chock block is connected to a positioning means in such a way that its position may be readily adjusted with respect to the chock block which holds the second forming roll of the rolling mill pair so that a desired reduction in the metal being rolled is achieved.

The bearing elements comprise (1) a radial bearing extending length-wise along the forming roll and partially surrounding the circumferential surface of the roll in a closely fitting, supporting relationship, and (2) thrust bearings adapted to engage a portion of the non-driven end of each of the cylindrical rolls in a close fitting relationship.

In one important embodiment, the radial bearing, constructed of a single or multiple elements with or without spacers, extends approximately 180° around the circumferential surface of the roll. The thrust bearing extends around approximately 180° of the roll end face opposite the drive, making contact with a fraction of its surface. These bearing elements which are positioned within chocks are preferably made of high-strength mechanical carbon or graphite or other typical metallic sleeve bearing compositions such as bearing bronzes, preferably having a hardness of at least 80 Scleroscope. The chock block positioning means may comprise two or more position-controlled rods connected to one chock block which adjust its position relative to a second chock block to a distance determining the thickness of the rolled product. The linear positions of these rods are independently adjustable by means of automatically controlled hydraulic cylinders or mechanical screw mechanisms. It is preferred that the chock blocks have internal passages for the circulation of cooling fluid when the mill is used for hot rolling.

Thus, the novel rolling mill bearing assembly disclosed herein supports a rolling mill along its length and its circumferential surface when in operation, thereby allowing the use of rolls of small diameter without sacrificing roll stiffness. The use of these bearings, therefore, permits the rolling mill stand to be simple, compact, inexpensive to build and operate, and easy to maintain.

DESCRIPTION OF THE PREFERRED EMBODIMENTS

Figure 1:
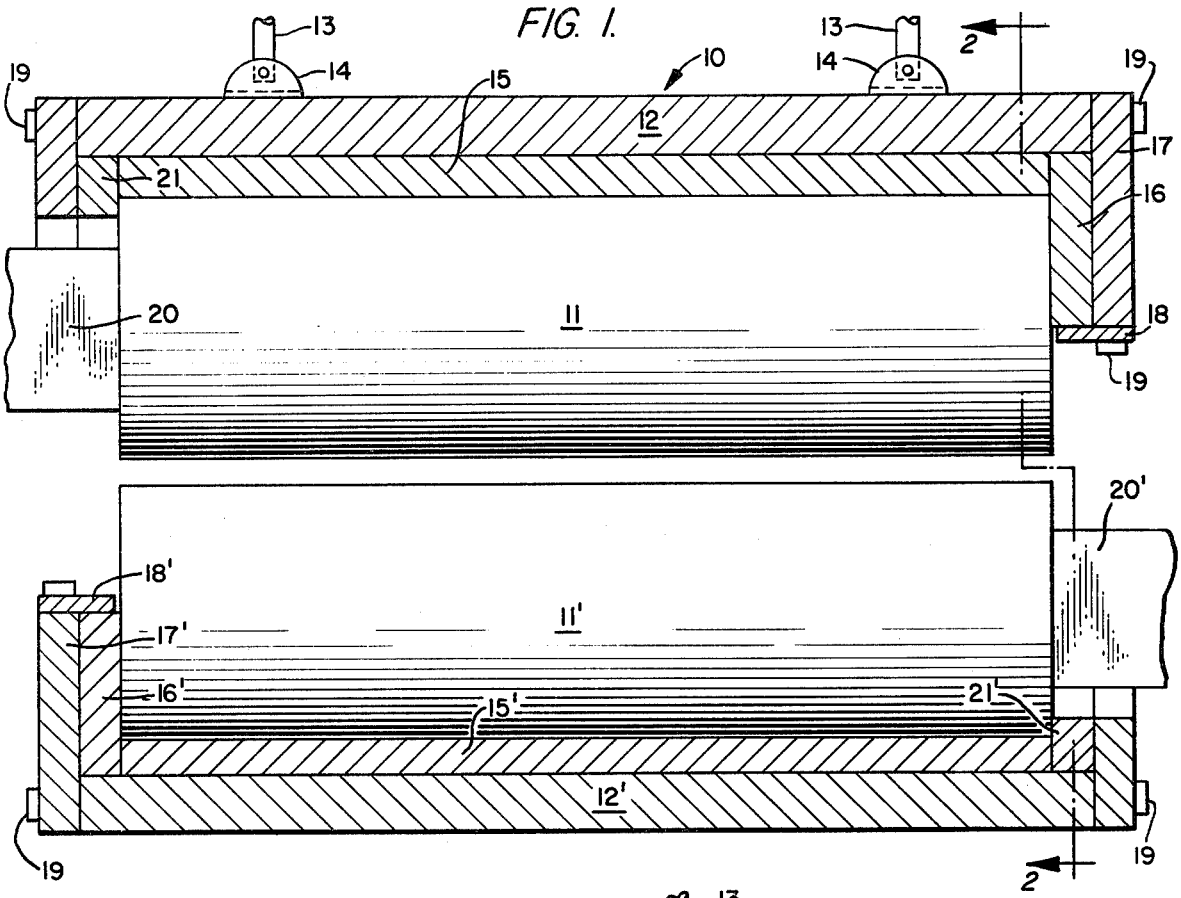
FIG. 1 is a view of a rolling mill assembly in accordance with the present invention with the rolls in perspective and the chock assembly in cross-section.

Referring to FIG. 1, rolling mill assembly 10 comprises two rolling rolls, first roll 11 and second roll 11', which for hot rolling preferably are made of hot working steel or other metallic or non-metallic material with good properties at elevated temperatures or (for cold rolling) tool steel, high-quality silicon carbide, or cemented tungsten carbide. Rolls 11 and 11' are housed within first and second chock blocks 12 and 12'. Chock block 12 is itself attached to position adjustment rods 13 by means of mounting brackets 14 on chock block 12. The distal ends of rods 13 are attached to position adjusting means (not shown), for example, servo controlled hydraulic cylinders or mechanical screw means. Although two position adjustment rods 13 are shown in the drawing, more than two rods should be used for rolling wide materials to insure a flat product. With three or more rods, the curvature of the roll in the longitudinal direction can be adjusted to match the curvature of the other roll.

Although the drawing appears to show a top chock block 12 above a bottom chock block 12', it is emphasized that chock block 12 need not necessarily be in a position above chock block 12'. Indeed, in many applications the chock blocks would be positioned side by side so that the material to be worked passes in a vertical direction. With the orientation shown in the drawing, the material to be rolled would travel in a horizontal direction through the two rolls. Furthermore, in a preferred embodiment, one chock block is fixed relative to the other chock block which is movable. Of course, it is possible to provide means for moving each chock block to a position which determines the thickness of the metal material being rolled.

Still referring to FIG. 1, first and second radial bearings 15, 15' and first and second thrust bearings 16, 16' preferably made of high strength, mechanical carbon or graphite or bearing bronze, fit within chock blocks 12, 12' in a closely fitting manner. Radial bearings 15, 15' are hemi-cylindrical in shape, FIG. 2, and extend lengthwise of and make contact with the forming rolls 11, 11' in the radial direction. Bearings 21, 21' may be provided for the driven ends of roll 11, 11'; however, such bearings are optional, depending upon the nature of the drive.

Figure 3:
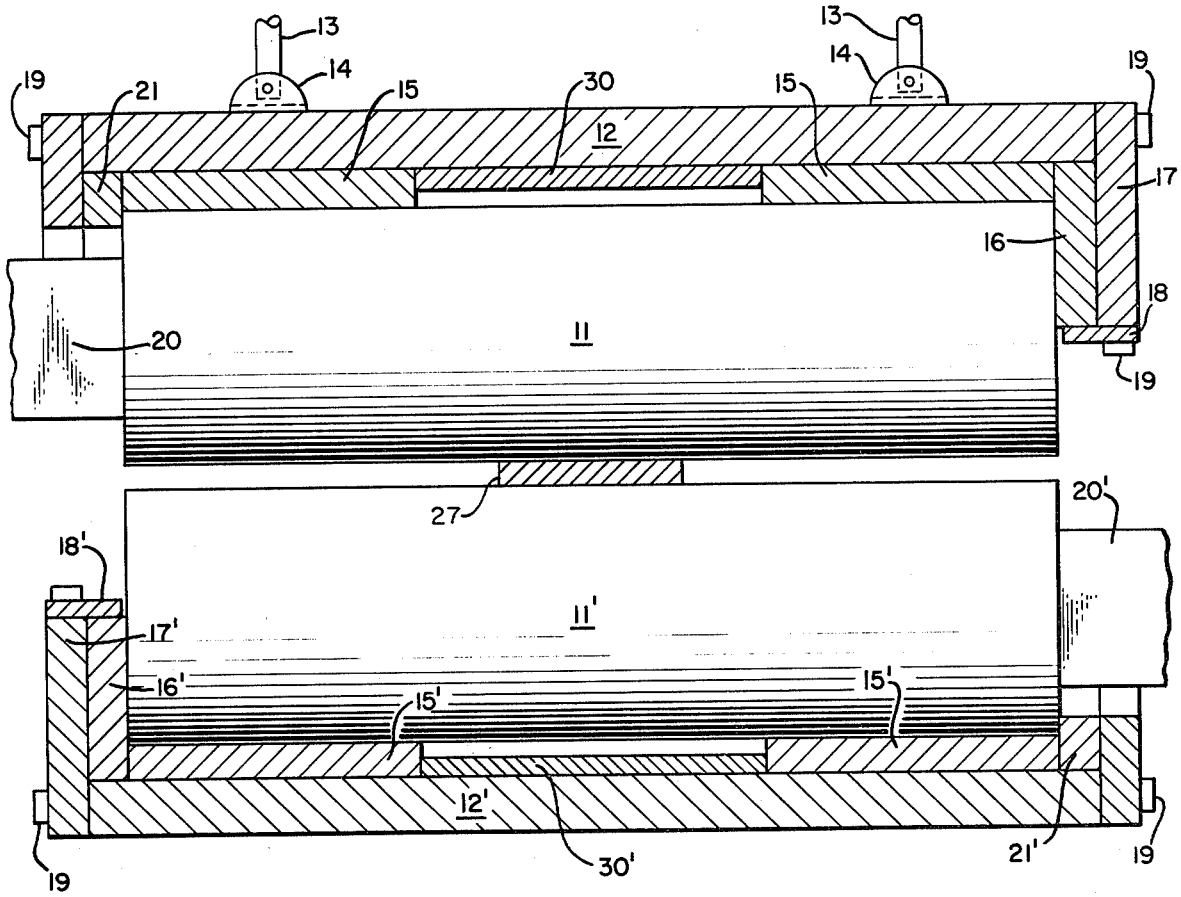
FIG. 3 is a view similar to FIG. 1 but showing an embodiment of the invention on which the radial bearings are segmented and have one or more spacers between segments.

As is shown in FIG. 3, the radial bearings need not themselves extend the entire length of the roll but may be segmented with spacers 30 positioned between each pair of segments forming a bearing. The spacers typically are made of carbon or steel and are held in place by clamps (not shown) attached to the chock blocks. The use of spacers gives better surface quality on narrow material which is rolled by the roll surfaces between the spacers as is shown by material 27 since the rolling surface of the rolls does not touch the bearing surface and hence is less apt to become scratched or dirty.

Figure 2:
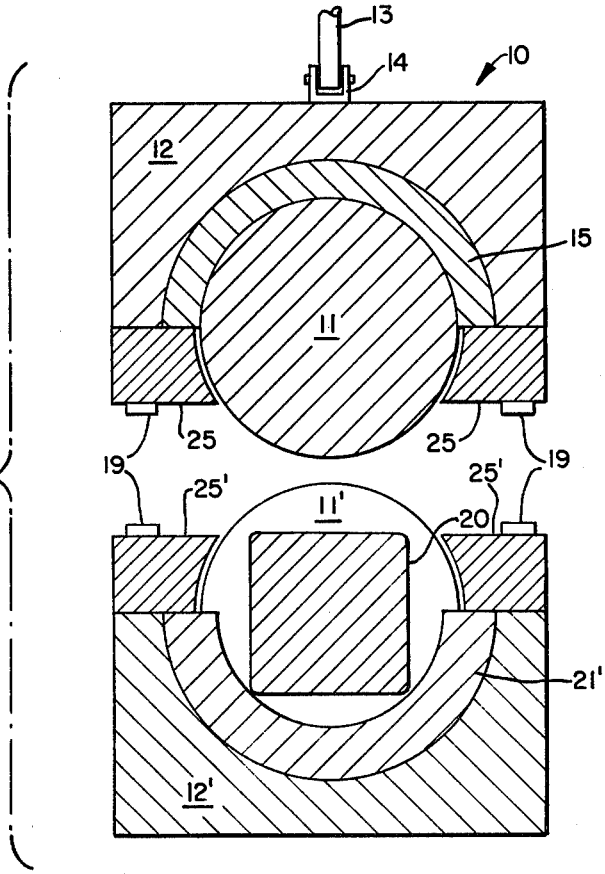
FIG. 2 is a cross sectional view taken along line 2—2 of FIG. 1.

Referring to FIGS. 1 and 2, the radial bearings 15, 15' and thrust bearings 16, 16', are held in place by chock end plates 17, 17', and bearing clamps 18, 18' which also provide a controlled compressive preload to the bearing elements. Chock end plates and bearing clamps are themselves secured by means of machine screws 19. Similar plates and clamps may be provided for the driven ends of rolls 11, 11'; however, the driven ends may be open in certain situations.

During a rolling operation, a material such as that shown by reference numeral 27 in FIG. 3 is sandwiched between the two forming rolls which are moved toward each other to provide a distance between them that will flatten the material to the desired thickness. Thus, part of the circumferential surface of the roll is pushed against the radial bearings. Thus, the radial bearings can be said to support the rolls during the rolling operation. To maintain the rolls within the chocks 12 and 12' when the rolls are separated, roll guides 25, 25' are provided. These roll guides are held onto chock block 12, 12' by machine screws 19. Thus, when the rolls 11, 11' are not being compressed against a piece of metal being rolled, the roll guides 25, 25' maintain the rolls within the chock assembly. Of course, when a roll is a bottom roll, that roll would rest on the radial bearing. Some support for each roll is also provided by necks 20, 20'. When the rolls are separated from each other, some play between the rolls and the chock assembly (i.e. between the roll guides and the radial bearings) is permissible. Indeed, movement of up to about ½ inch can be tolerated.

Necks 20, 20' of forming rolls 11, 11' may be square, rectangular, splined or other convenient shape for receiving the torque applied by a simple sleeve coupling (not shown). Because of the small size of the rolls used in the present invention, it is preferred to orient each roll so that the necks are at opposite ends of the assembly as is shown in the drawing. Because the motors used to drive the rolls are large in comparison with the rolls, it is apparent that alternating the neck positions on opposite ends of the assembly is advantageous when accommodating motors to drive the rolls.

For hot rolling, a suitable hot-working steel such as H13 or other material with good elevated-temperature properties is preferably used for the work rolls, whereas for cold rolling, rolls are made of tungsten carbide, high-quality silicon carbide, or, of a wear resistant tool steel such as D2. A rolling lubricant, normally a water-soluble oil emulsion, is sprayed over the complete roll face continuously to serve as a coolant, rolling lubricant and bearing lubricant. The bearings and rolls may also operate without lubricant if desired for hot rolling applications. In this case, the mill assembly preferably should be operated in an inert or reducing atmosphere to prevent bearing oxidation. For hot rolling, it is preferred that chock blocks 12, 12' be provided with internal passages (not shown) for the circulation of a cooling fluid.

The invention is further illustrated by the following non-limiting example.

Annealed brass strip of composition 70% copper, 30% zinc, 1.5 inches wide is cold-rolled using the roll assembly of this invention as is shown in FIG. 3 from a thickness of 0.050 to 0.020 inches, using 3-inch diameter tungsten carbide rolls lubricated by water containing 7% soluble oil which is continuously sprayed over the roll faces. In this embodiment the material to be rolled is rolled by continuously feeding the material to the roll faces which do not contact the bearings. This represents a 60% reduction in thickness, a very large reduction in one pass.

The product quality (flatness, uniformity) was found to be very good. The estimated coefficient of friction of the bearings and also between the rolls and strip is about 0.03 at speeds above about 60 ft/minute.

The required separating force for this example is about 36,000 lbs. and the required rolling torque is about 8,000 in-lb including bearing losses.

By using the bearing assembly of the present invention, it is possible to use rolling rolls with diameters in the range of 1½–4 inches. Such rolls are considered "small rolls". Of course the bearing assembly disclosed herein can be used with larger rolls to great advantage. Thus there is no intention to limit the invention to mills employing small rolls.

Typical conventional practice would utilize larger diameter steel rolls. A reduction this great would typically cause poor product flatness and lead to using two reductions to achieve the same result, instead of one.

The new bearing design disclosed herein, therefore, permits the use of small diameter rolling rolls without sacrificing roll stiffness and without requiring the complexity of backup rolls as in four-high and miscellaneous rolling mills. Because the small rolls are supported along their length, the finished product has good dimensional stability and flatness.

The small roll size and simple bearing design of the present invention make the use of tungsten (or other type of) carbide rolls for cold rolling practical and affordable, giving the advantages of longer roll life between polishing operations, better product quality and thinner minimum product gages.

The number of rolling mill stands required in a rolling operation is reduced since the use of small but stiff rolls, made possible by the new bearing design combined with the relatively high rolling force available, permits greater thickness reductions to be made in a single pass through the mill. Small roll size and weight also imply easier and faster roll changes and the small rolls require less turning torque permitting lower cost drives.

In view of the foregoing, it may be seen that the several objects of the present invention have been achieved and other advantageous results attained.

As various changes could be made in the above preferred embodiment without departing from the scope of the invention, it should be understood that all matter contained in the above description or shown in the accompanying drawings shall be interpreted as illustrative and not in a limiting sense.

I claim:

1. A rolling mill assembly for rolling metal comprising:

1. a first roll assembly including a first chock block for housing a first rolling roll, a first cylindrical rolling roll housed by said first chock block, said rolling roll having a neck extending through one end of the assembly, said neck providing the means for applying torque to said first roll for driving said first roll, a radial bearing assembly comprised of multiple bearing elements and at least one spacer which does not contact said first rolling roll, said spacer being between said multiple bearing elements to enable a material to be rolled between roll surfaces which make no contact with the radial bearing assembly, said bearing assembly being positioned between said first chock block and said first cylindrical roll, said bearing elements extending in a circumferential direction around said first rolling roll and along the length of said first rolling roll and being formed from a material selected from a member of the group of carbon and graphite, and a thrust bearing positioned in the end of said first chock block opposite the end of the assembly from which said first roll is driven, said thrust bearing contacting at least a portion of the end face of said rolling roll;

2. a second roll assembly including a second chock block for housing a second rolling roll, a second cylindrical rolling roll housed by said second chock block, said rolling roll having a neck extending through one end of the assembly, said neck providing the means for applying torque to said second roll for driving said second roll, said second roll being positioned in said second chock block so that its neck is facing a direction opposite that which the neck on said first roll faces, a radial bearing assembly comprised of multiple bearing elements and at least one spacer which does not contact said second rolling roll, said spacer being between said multiple bearing elements to enable a material to be rolled between roll surfaces which make no contact with the radial bearing assembly, said bearing assembly being positioned between said second chock block and said second cylindrical roll, said radial bearing elements extending in a circumferential direction around said second rolling roll and along the length of said second rolling roll and being formed from a material selected from a member of the group of carbon and graphite and a thrust bearing positioned in the end of said second chock block opposite the end of the assembly from which said second rolling roll is driven, said thrust bearing contacting at least a portion of the end face of said second rolling roll; and, 3. means for moving said rolling rolls relative to one another to produce a separation therebetween suitable for rolling metal to a desired thickness.

2. A process for rolling strip material comprising:

A. providing 1. a first roll assembly including a first chock block for housing a first rolling roll, a first cylindrical rolling roll housed by said first chock block, said rolling roll having a neck extending through one end of the assembly, said neck providing the means for applying torque to said first roll for driving said first roll, segmented radial bearings positioned between said first chock block and said first cylindrical roll, said radial bearings extending in a circumferential direction around said first rolling roll and along the length of said first rolling roll, the segments of the radial bearing being separated by a spacer which is wider than the material to be rolled and which does not touch the surface of the rolling roll, and a thrust bearing positioned in the end of said first chock block opposite the end of the assembly from which said first roll is driven, said thrust bearing contacting at least a portion of the end face of said rolling roll;

2. a second roll assembly including a second chock block for housing a second rolling roll, a second cylindrical rolling roll housed by said second chock block, said rolling roll having a neck extending through one end of said second chock block, said neck providing the means for applying torque to said second roll for driving said second roll, segmented radial bearings positioned between said second chock block and said second cylindrical roll, said radial bearing extending in a circumferential direction around said second rolling roll and along the length of said second rolling rolls, the segments of the radial bearing being separated by a spacer which is wider than the material to be rolled and which does not touch the surface of the rolling roll, and a thrust bearing positioned in the end of said second chock block opposite the end of the assembly from which said second roll is driven, said thrust bearing contacting at least a portion of the end face of said second rolling roll;

B. moving said rolls relative to one another to produce a separation therebetween suitable for rolling metal to a desired thickness; and C. rolling material by feeding material to be rolled through said rolls in the vicinity of the rolls adjacent spacers thereby rolling the material between roll surfaces which do not contact radial bearings.

* * * * *